US008794612B2

(12) United States Patent
Chuang

(10) Patent No.: US 8,794,612 B2
(45) Date of Patent: Aug. 5, 2014

(54) QUICK ADJUSTABLE CLAMP

(75) Inventor: Chun-Huan Chuang, Taichung Hsien (TW)

(73) Assignee: Ehoma Industrial Corporation, Tali, Taichung Hsien (TW)

( * ) Notice: Subject to any disclaimer, the term of this patent is extended or adjusted under 35 U.S.C. 154(b) by 553 days.

(21) Appl. No.: 13/167,499

(22) Filed: Jun. 23, 2011

(65) Prior Publication Data

US 2012/0326375 A1 Dec. 27, 2012

(51) Int. Cl.

| | |
|---|---|
| ***B25B 1/04*** | (2006.01) |
| ***B25B 5/04*** | (2006.01) |
| ***B25B 5/00*** | (2006.01) |
| ***B25B 5/10*** | (2006.01) |

(52) U.S. Cl.

CPC ..... *B25B 5/101* (2013.01); *B25B 5/103* (2013.01); *B25B 5/006* (2013.01)

USPC ..... 269/128; 269/249; 269/239

(58) Field of Classification Search

CPC ..... B23B 5/005

See application file for complete search history.

(56) References Cited

U.S. PATENT DOCUMENTS

| | | | | | |
|---|---|---|---|---|---|
| 2,726,694 | A * | 12/1955 | Saxton | ..... | 269/218 |
| 4,181,392 | A * | 1/1980 | Casler et al. | ..... | 439/432 |
| 4,258,908 | A * | 3/1981 | Goff et al. | ..... | 269/239 |
| 5,758,870 | A * | 6/1998 | Weaver | ..... | 269/329 |
| 6,893,012 | B2 * | 5/2005 | Wong | ..... | 269/249 |
| 7,436,275 | B2 * | 10/2008 | Dale | ..... | 333/255 |
| 7,764,150 | B2 * | 7/2010 | Dale | ..... | 333/255 |

* cited by examiner

*Primary Examiner* — Lee D Wilson
*Assistant Examiner* — Seahee Yoon
(74) *Attorney, Agent, or Firm* — Muncy, Geissler, Olds & Lowe, P.C.

(57) ABSTRACT

A quick adjustable clamp includes a first clamp jaw, a second clamp jaw, a driving screw and a nut. The second clamp jaw is extended with a receiving section. The receiving section is formed with a notch facing the first clamp jaw. The driving screw has one end pivotally connected to the first clamp jaw. The nut is mounted around the driving screw and configured to be movably received in the notch. For quick adjusting a span of the clamp, the nut can be removed from the notch, quick moved along the driving screw, and then reengaged by the notch.

8 Claims, 7 Drawing Sheets

QUICK ADJUSTABLE CLAMP

BACKGROUND OF THE INVENTION

1. Technical Field

The present invention relates to clamps, and more particularly, to a clamp for holding an external article, wherein the span of the clamp can be quick adjusted.

2. Description of Related Art

Referring to FIG. 1, a conventional clamp typically has a first clamp jaw 1 and a second clamp jaw 2 for holding an article jointly. The second clamp jaw 2 is extended with a receiving section 3, and the receiving section 3 is provided with an adjusting member 4 having internal threaded. The adjusting member 4 is mounted around a driving screw 5, whose one end is pivotally connected to the first clamp jaw 1, and an opposite end is equipped with a handle 6. Each of the first clamp jaw 1 and the second clamp jaw 2 has its free end equipped with a clamping chunk 7.

By operating the handle 6, the driving screw 5 moves with respect to the adjusting member 4, so that a joint between the driving screw 5 and the first clamp jaw 1 can be drawn toward or away from the adjusting member 4. When the joint and the adjusting member 4 are close to each other, the first clamp jaw 1 and the second clamp jaw 2 are opened to wide the span between the two clamping chunks 7. On the contrary, when the joint and the adjusting member 4 are far from each other, the first clamp jaw 1 is close to the second clamp jaw 2, so the span between the two clamping chunks 7 is shortened. When clamp is operated to clamp an external article, a user has to first operate the handle 6 until the span becomes wider than the article, and then operates the handle 6 reversely to draw the first clamp jaw 1 and second clamp jaw 2 together to hold the article, while the driving screw 5 continuously serves to ensure the clamping force exerted onto the article.

During the foregoing adjustment of the span, the user has to keep operating the handle 6 or the driving screw 5 could not move with respect to the adjusting member 4. However, since each rotation of the driving screw 5 only contributes to a small amount of displacement, in the event that the article is much wider than the initial span of the clamp, adjustment of the span becomes very effort-consuming and time-consuming, making the conventional clamp inconvenient in use.

SUMMARY OF THE INVENTION

In view of the shortcoming of the conventional device, the present invention provides a quick adjustable clamp with the advantage of quick adjustment of the span of the clamp.

According to the present invention, the quick adjustable clamp comprises:

a first clamp jaw having one end configured to be a first working end;

a second clamp jaw having one end configured to be a second working end, the second clamp jaw and the first clamp jaw being pivotally connected at ends thereof opposite to the first and second working ends, such that the first working end and the second working end are allowed to be drawn together or away from each other, beyond the pivotally connected ends of the first and second working ends, and the receiving section having a notch facing the first clamp jaw;

a driving screw having one end pivotally connected to the first clamp jaw; and a nut screwedly mounted around the driving screw and configured to be movably received in the notch.

The efficacy of the present invention includes that in virtue of the detachable combination between the notch and the nut, when quick adjustment of the span of the clamp is desired, the nut can be removed from the notch so that the nut can be fast moved along the driving screw to allow the jaws to quick open or close.

The efficacy of the present invention includes that a spring is provided between the first clamp jaw and the receiving section, which spring makes the nut normally abut against the notch, thereby preventing the driving screw and the nut from unintentionally leaving the receiving section.

The efficacy of the present invention includes that a first clamping chunk and a second clamping chunk are rotatably connected to the first working end and the second working end respectively, and the chunks are formed on their different surfaces with different friction patterns, such as crossed lines, parallel lines and v-shaped grooves. For example, crossed lines provide general friction while v-shaped grooves are particularly useful to hold a columnar article or an article with right angles. By providing these friction patterns on the first clamping chunk and the second clamping chunk, the clamp of the present invention is highly versatile.

The efficacy of the present invention includes that the first clamp jaw has a first bent section and the second clamp jaw has a second bent section, wherein the bent sections define the void space between the jaws. In virtue of the void space, during the clamping action, the jaws will not interfere with an external article to be held by the first clamping chunk and the second clamping chunk and cause the clamp to clamp the article infirmly.

The efficacy of the present invention also includes that the nut has each of its two ends formed with a cap, so that when the nut is settled in the notch, the caps cover gaps between the notch and the nut, thereby preventing external articles, such as the use's skin or clothing, from being hooked.

The efficacy of the present invention still includes that the receiving section is provided with a visor for receiving a force exerted thereon by a user so that the user can exerts force effectively without using extra effort.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

Figure 1:
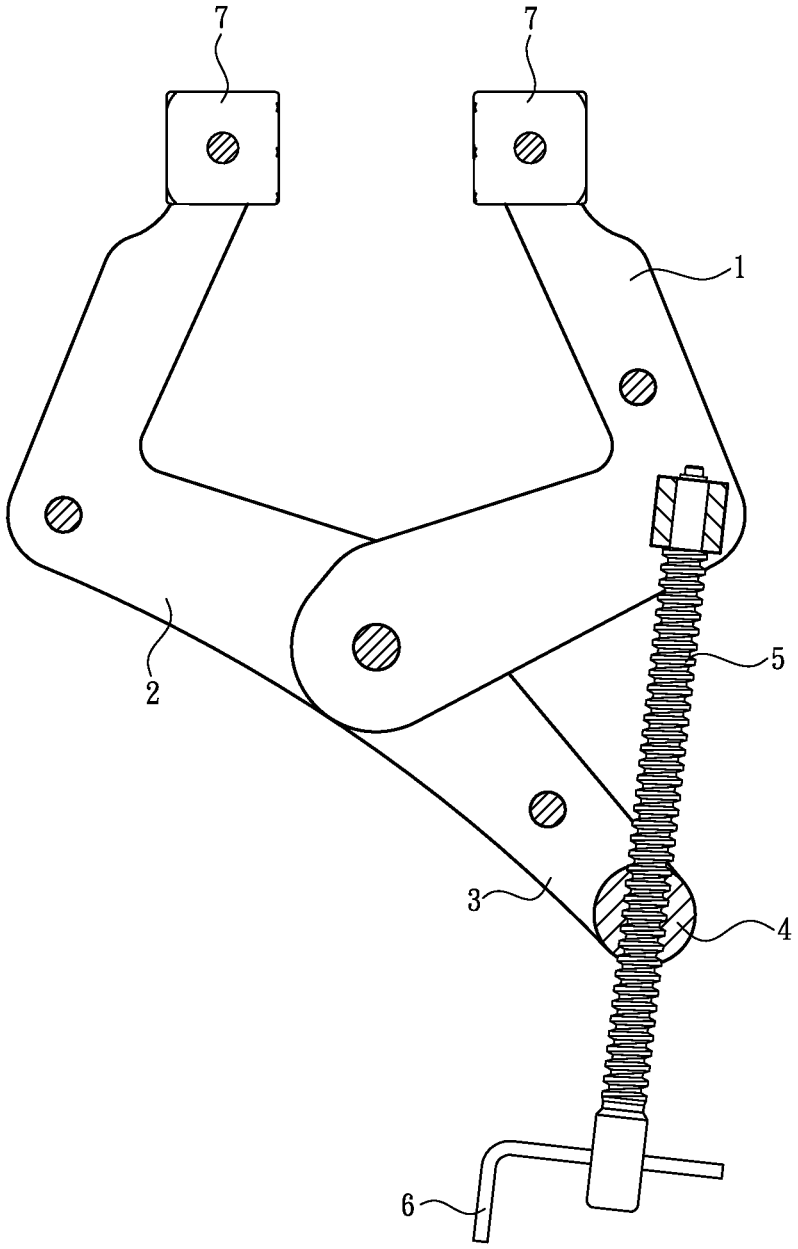
FIG. 1 PRIOR ART
FIG. 1 is a cross-sectional view of a conventional clamp.
Figure 2:
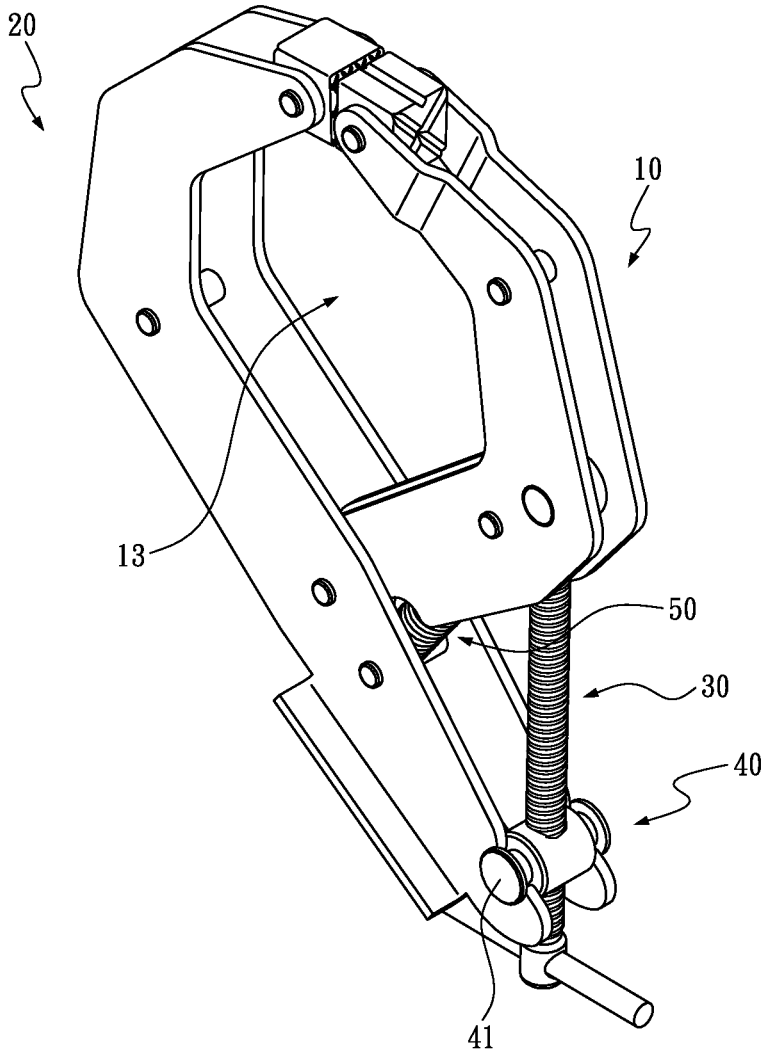
FIG. 2 is a perspective view of a quick adjustable clamp according to the present invention.
Figure 3:
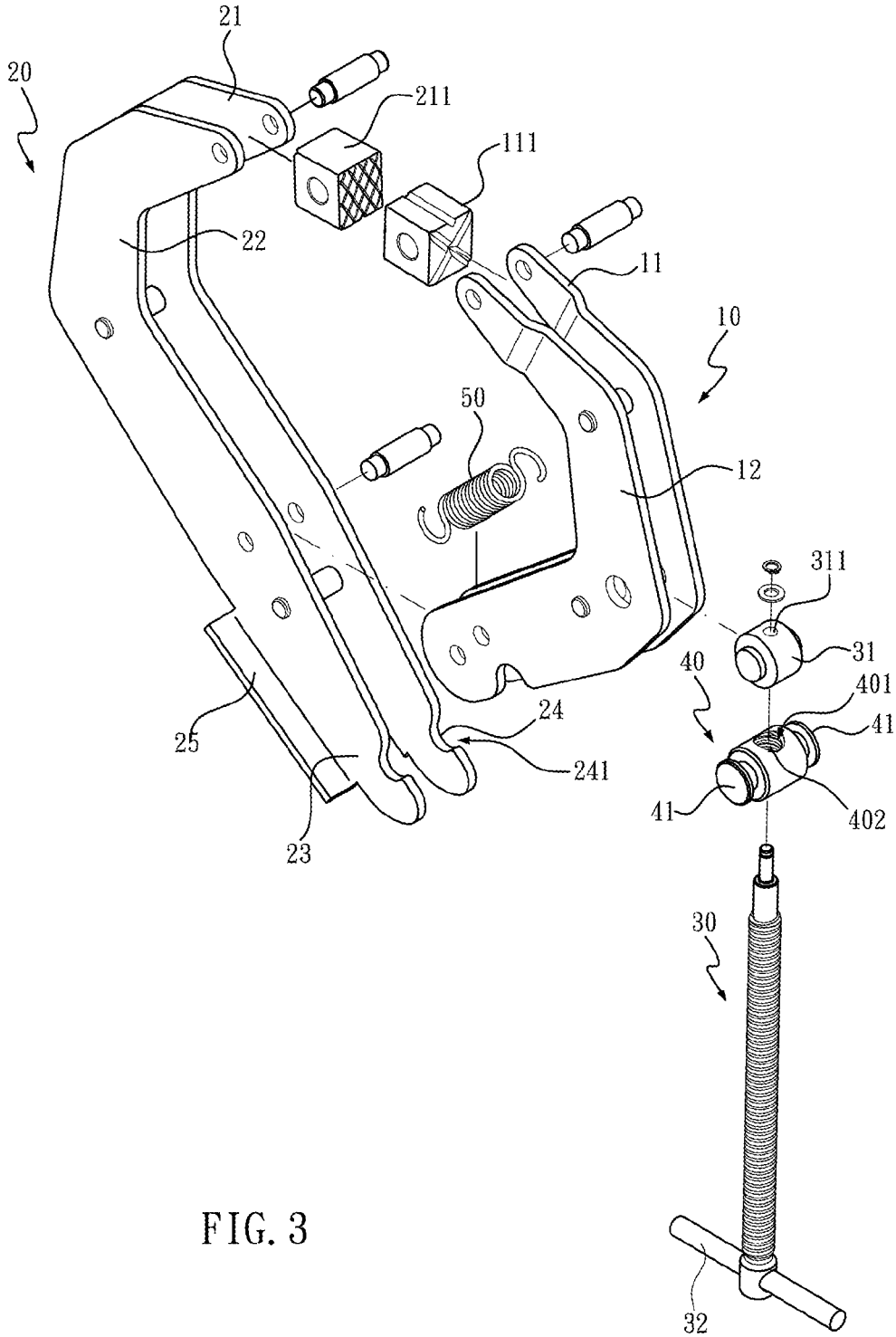
FIG. 3 is an exploded view of the quick adjustable clamp of the present invention.
Figure 4:
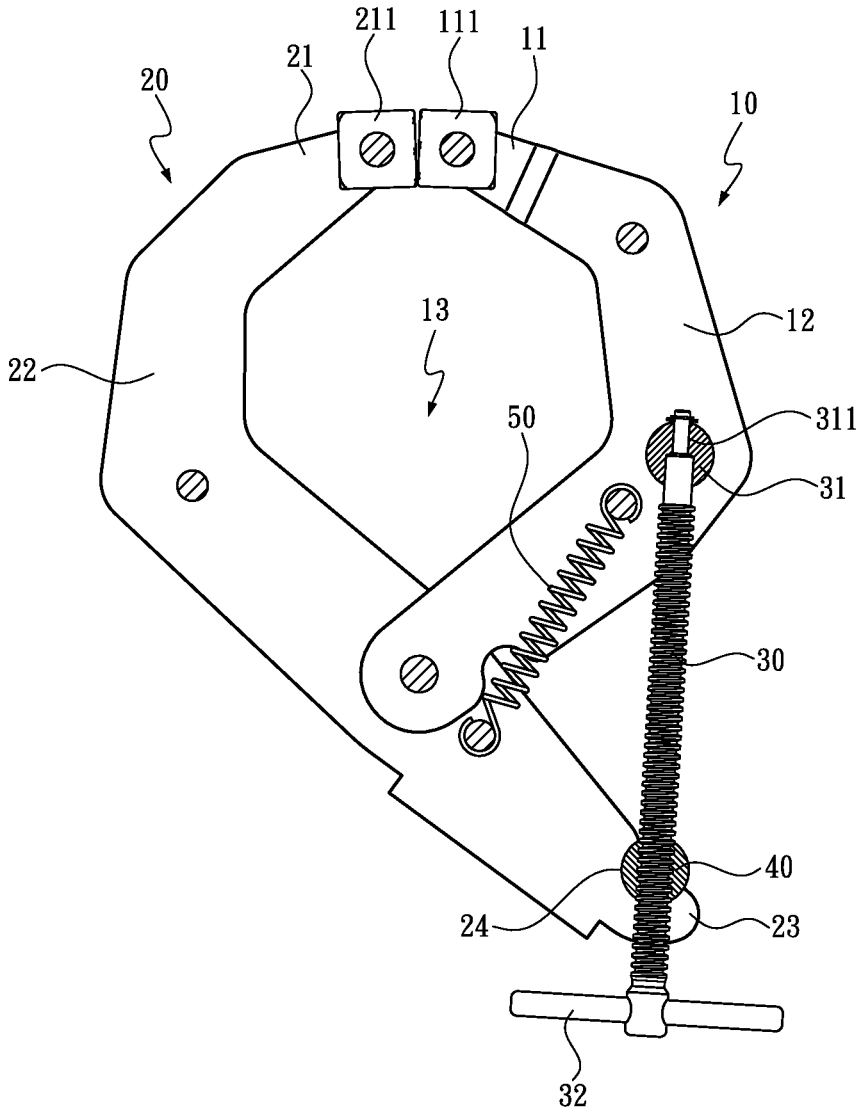
FIG. 4 is a cross-sectional view of the quick adjustable clamp of the present invention.

Referring to FIG. 2 through FIG. 4, the present invention provides a quick adjustable clamp primarily comprising a first clamp jaw 10, a second clamp jaw 20, a driving screw 30, a nut 40 and a spring 50.

The first clamp jaw 10 has one end configured to be a first working end 11, to which a first clamping chunk 111 is rotatably attached.

The second clamp jaw 20 has one end configured to be a second working end 21, to which a second clamping chunk 211 is rotatably attached. The second clamp jaw 20 and the first clamp jaw 10 are pivotally connected at their ends opposite to the first and second working ends 11, 21, such that the first working end 11 and the second working end 21 are allowed to be drawn together or away from each other. In addition, the first clamp jaw 10 includes a first bent section 12 near the first working end 11 while the second clamp jaw 20 includes a second bent section 22 near the second working end 21, such that the first working end 11 and the second working end 21 face each other, and an void space 13 is left between the first clamp jaw 10 and the second clamp jaw 20. On the second clamp jaw 20, there is a receiving section 23 extending beyond the pivotally connected ends of the first and second working ends 11, 21. The receiving section 23 has its side facing the first clamp jaw 10 provided with a notch 24, which is in the form of a curved-bottom recess and provided with an opening 241 on one lateral side facing the first clamp jaw 10, and the other side provided with a visor 25 for receiving a force exerted thereon by a user.

The driving screw 30 is pivotally connected to the first clamp jaw 10 through a spinner 31. The spinner 31 has a through hole 311 for receiving one end of the driving screw 30, such that the driving screw 30 is allowed to swing with respect to the first clamp jaw 10. The driving screw 30 has an opposite end provided with a handle 32 to be held and rotated by a user who intends to operate the driving screw 30.

The nut 40 is a column-like member with its longer axis perpendicular to the longer axis of the driving screw 30. A bore 401 is disposed on the nut 40 with a complete thread 402 provided therein for being screwedly mounted around the driving screw 30. The nut 40 is configured to be movably received in the notch 24. The nut 40 has each of its two ends formed with a cap 41, so that when the nut 40 is settled in the notch 24, the caps 41 cover gaps between the notch 24 and the nut 40, thereby preventing external articles, such as the use's skin or clothing, from being hooked.

The spring 50 is provided between the first clamp jaw 10 and the receiving section 23. The spring 50 is an extension spring that is normally tense so that when the nut 40 sits in the notch 24, the spring 50 makes the nut 40 normally abut against the notch 24, thereby preventing the driving screw 30 and the nut 40 from unintentionally leaving the receiving section 23.

With the foregoing configuration, the quick adjustable clamp of the present invention works as described below.

Figure 7:
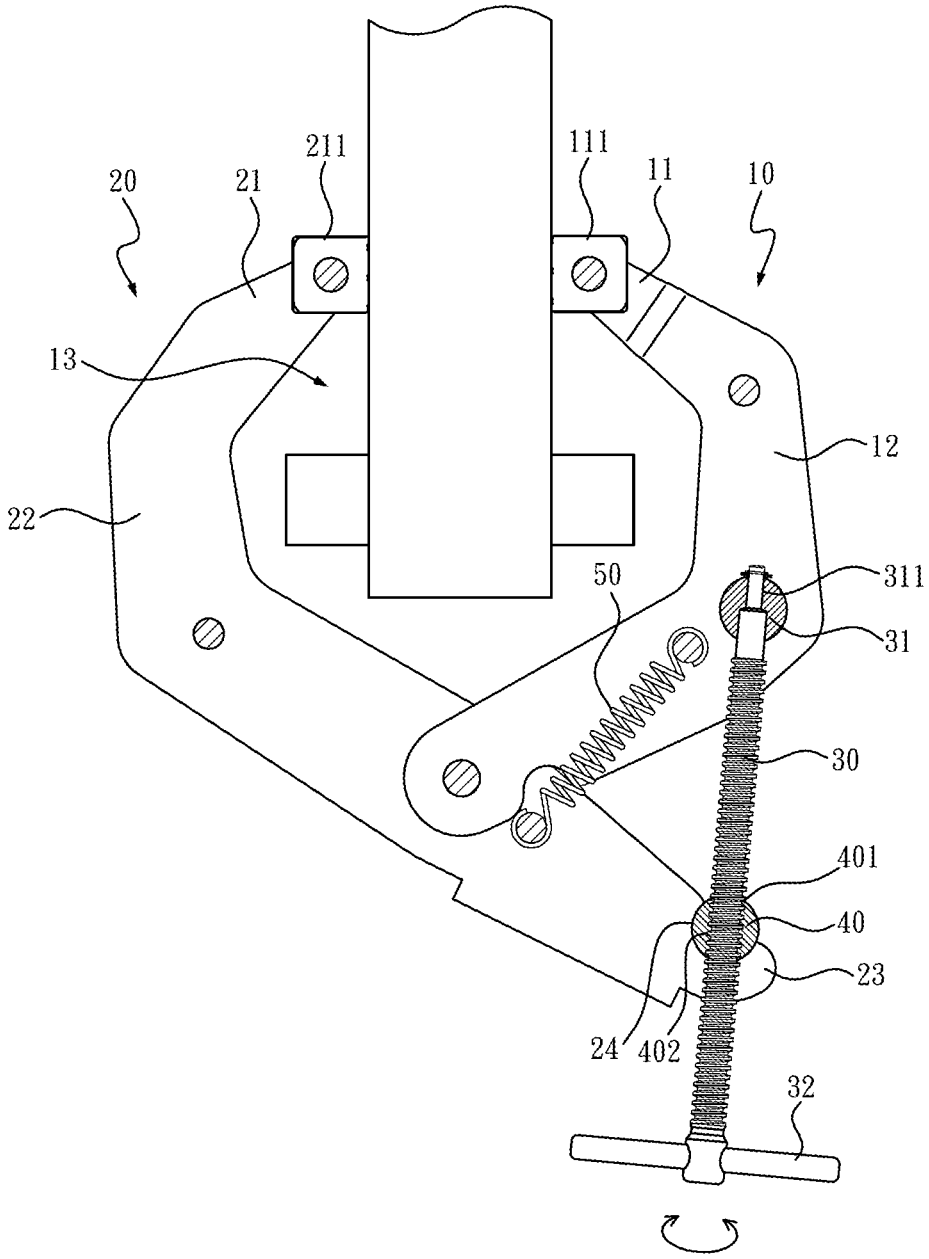

For normal operation, the nut 40 sits in the notch 24. At this time, by rotating the driving screw 30 through operating the handle 32 in either direction, a change in distance takes place between the nut 40 sitting in the notch 24 and the spinner 31 because the nut 40 moves along the driving screw 30 under said rotation while the spinner 31 stays at the end of the driving screw 30. Referring to FIG. 4, rotation of the driving screw 30 can hereinto shorten the distance between the nut 40 and the spinner 31, thereby making the first clamp jaw 10 and the second clamp jaw 20 separate, so that an external article to be clamped can be put between the first clamping chunk 111 and the second clamping chunk 211 and then clamped when the handle 32 is operated reversely, as shown in FIG. 7.

Since the spinner 31 is pivotally connected to the first clamp jaw 10 and the column-like nut 40 is rotatably received by the curved-bottom notch 24, when the first clamp jaw 10 moves with respect to the second clamp jaw 20, the spinner 31 and the nut 40 allows the driving screw 30 to the adapt itself to the change without the risk of being jammed.

Figure 5:
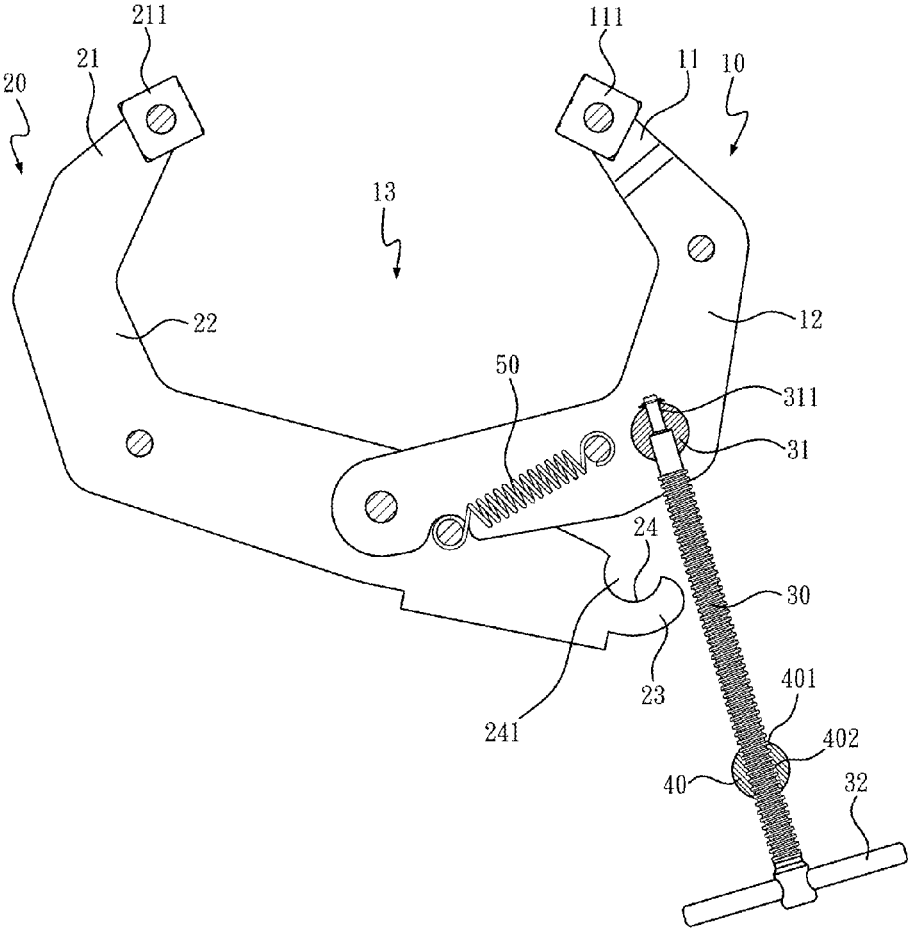
FIGS. 5 through 7 are schematic drawings illustrating the present invention.

On the other hand, when the disclosed clamp needs to be opened to the most, referring to FIG. 5, the nut 40 can be manually pulled out from the notch 24 to allow the first clamp jaw 10 and the second clamp jaw 20 to move with respect to each other freely by pivoting on their connected end. To pull the nut 40 out from the opening 241 of the notch 24, a user can hold the handle 32 or the driving screw 30 with one hand, and exerts a force on the visor 25 with the other hand, so that the spring 50 is extended to allow the escape of the nut 40. In virtue of the visor 25 of the present invention, the user can exerts force effectively without using extra effort.

Figure 6:
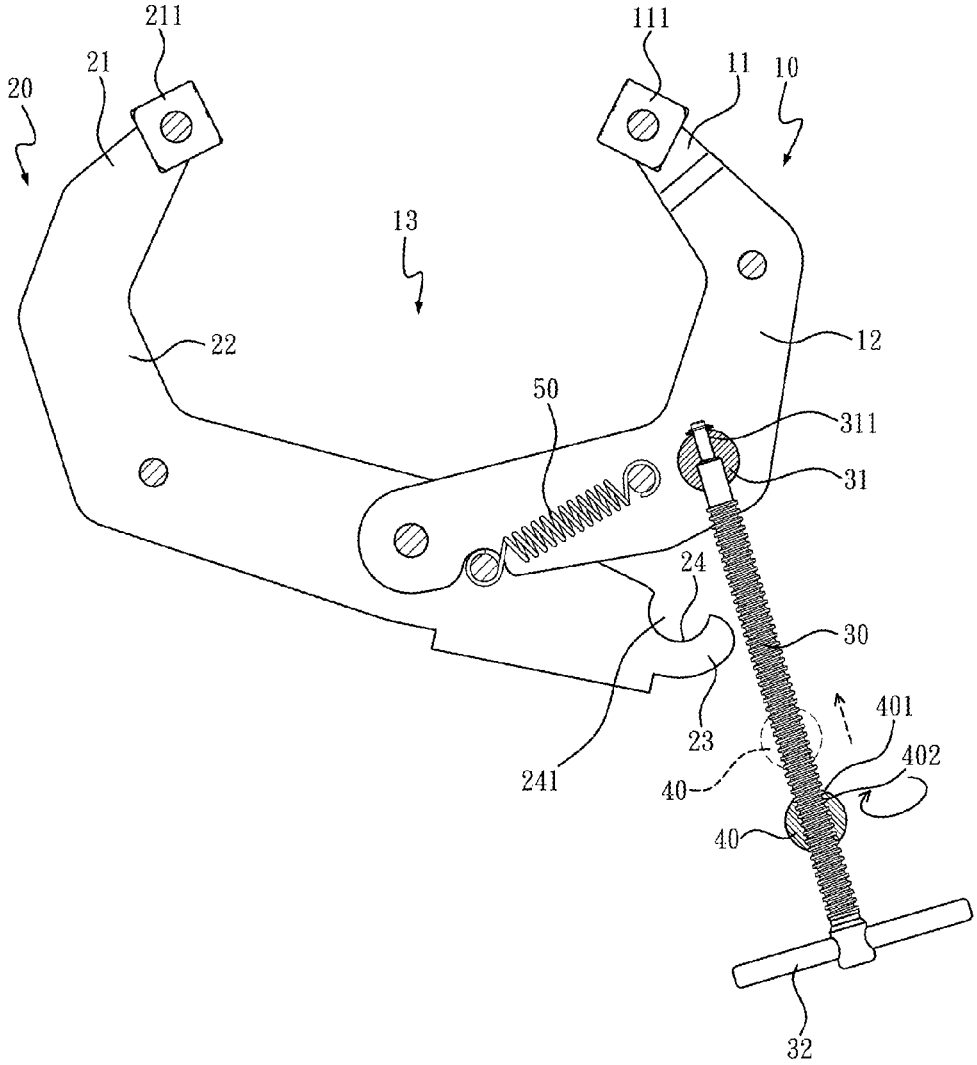

Then, as shown in FIG. 6, to make the first clamp jaw 10 and the second clamp jaw 20 become controlled by the driving screw 30 again, the user just needs to rotate the nut 40 with fingers directly to make it move toward the driving screw 30, and then draw the driving screw 30 toward the receiving section 23 while exerting on force on the reverse side of the visor 25 until the nut 40 again sits in the notch 24. Afterward, the user can operate the handle 32 to make fine tuning of the distance between the first clamping chunk 111 and second clamping chunk 211, thereby holding an external article firmly.

With the option of freeing the clamp jaws 10, 20 from the control of the driving screw 30 temporarily through quick operation, the present invention has the advantage of quick adjustment in span.

In addition, the first clamping chunk 111 and the second clamping chunk 211 rotatably attached to the first working end 11 and the second working end 21 respectively may be formed on their different surfaces with different friction patterns, such as crossed lines, parallel lines (not shown) and v-shaped grooves. For example, crossed lines provide general friction while v-shaped grooves are particularly useful to hold a columnar article or an article with right angles. Thereby, the user can rotate the chunks 111, 211 on the working ends 11, 21, to clamp an external article with suitable friction patterns. By providing these friction patterns on the first clamping chunk 111 and the second clamping chunk 211, the clamp of the present invention is highly versatile.

Furthermore, with the first bent section 12 and the second bent section 22, the first clamp jaw 10 and the second clamp jaw 20 define the void space 13 therebetween. In virtue of the void space 13, during the clamping action, the jaws 10, 20 will not interfere with an external article to be held by the first clamping chunk 111 and the second clamping chunk 211 and cause the clamp to clamp the article infirmly. Referring to FIG. 7, even for an article to be clamped has an end of a complicated structure and being wider than its part contacting the clamping chunks 111, 211, the clamp can hold it firmly without problem.

Still referring to FIG. 7, when the article clamped is to be removed from the clamp, a user may first operate the handle 32 to make the first clamping chunk 111 and the second clamping chunk 211 slightly release the article. Then the user may pull out the nut 40 from the notch 24 and quick open the first clamp jaw 10 and second clamp jaw 20 to release the article immediately.

The present invention has been described with reference to the preferred embodiments and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A quick adjustable clamp, comprising:

a first clamp jaw having one end configured to be a first working end;

a second clamp jaw having one end configured to be a second working end, the second clamp jaw and the first clamp jaw being pivotally connected at ends thereof opposite to the first and second working ends, such that the first working end and the second working end are allowed to be drawn together or away from each other, beyond the pivotally connected ends of the first and second working ends, and a receiving section having a notch possessing an opening facing the first clamp jaw;

a driving screw with one end pivotally connected to the first clamp jaw through a spinner, while the spinner has a through hole for receiving one end of the driving screw; and a nut provided with a bore possessing a complete thread disposed therein for being screwedly mounted around the driving screw, wherein when the driving screw rotates on the first clamp jaw through the spinner, the nut is configured to be movably received in or separated from the opening of the notch.

2. The quick adjustable clamp of claim 1, wherein a permanently stretched spring is provided between the first clamp jaw and the receiving section, with one end of the spring fixed at a point between the spinner of the first clamp jaw and the pivotal joint of the first clamp jaw and the second clamp jaw and the other end of the spring fixed at a point between the notch and the pivotal joint of the first clamp jaw and the second clamp jaw.

3. The quick adjustable clamp of claim 1, wherein the nut is columnar and the notch has a curved bottom.

4. The quick adjustable clamp of claim 1, wherein a first clamping chunk is rotatably connected to the first working end and a second clamping chunk is rotatably connected to the second working end.

5. The quick adjustable clamp of claim 1, wherein the first clamp jaw includes a first bent section near the first working end, and the second clamp jaw includes a second bent section near the second working end, so that a void space is defined between the first clamp jaw and the second clamp jaw.

6. The quick adjustable clamp of claim 1, wherein the driving screw has an opposite end equipped with a handle.

7. The quick adjustable clamp of claim 1, wherein the receiving section is provided with a visor.

8. The quick adjustable clamp of claim 1, wherein the nut has each of two ends thereof formed with a cap.

* * * * *